US009243504B2

(12) United States Patent
Thomen et al.

(10) Patent No.: US 9,243,504 B2
(45) **Date of Patent: *Jan. 26, 2016**

(54) DAMPER PIN

(71) Applicant: United Technologies Corporation, Hartford, CT (US)

(72) Inventors: Seth J. Thomen, Colchester, CT (US); Christopher Corcoran, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/143,828

(22) Filed: Dec. 30, 2013

(65) Prior Publication Data

US 2014/0112792 A1 Apr. 24, 2014

Related U.S. Application Data

(62) Division of application No. 13/048,618, filed on Mar. 15, 2011, now Pat. No. 8,876,479.

(51) Int. Cl.
*F01D 5/22* (2006.01)
*F01D 11/00* (2006.01)

(52) U.S. Cl.
CPC ..... *F01D 5/22* (2013.01); *F01D 11/006* (2013.01); *F01D 11/008* (2013.01); *F05D 2250/25* (2013.01); *Y10S 416/50* (2013.01)

(58) Field of Classification Search
CPC ..... F01D 5/22; F01D 5/225; F01D 5/16; F01D 5/26; F01D 25/06; F01D 11/006; F01D 11/008; F05D 2260/96
USPC ..... 415/138, 139, 119; 416/95, 96 R, 97 R, 416/190, 191, 193 A, 500, 145
See application file for complete search history.

(56) References Cited

U.S. PATENT DOCUMENTS

| | | | | |
|---|---|---|---|---|
| 4,035,102 | A * | 7/1977 | Maghon | 416/95 |
| 4,088,421 | A | 5/1978 | Hoeft | |
| 4,218,178 | A * | 8/1980 | Irwin | 415/114 |
| 4,478,554 | A | 10/1984 | Surdi | |
| 4,834,613 | A * | 5/1989 | Hansen et al. | 415/160 |
| 4,917,574 | A | 4/1990 | Dodd et al. | |
| 5,531,457 | A | 7/1996 | Tibbott et al. | |
| 5,746,578 | A | 5/1998 | Brassfield et al. | |
| 5,800,124 | A | 9/1998 | Zelesky | |
| 6,155,789 | A | 12/2000 | Mannava et al. | |

(Continued)

OTHER PUBLICATIONS

Stairplan, Staircase Spindles and Balusters, "The Artist's Materials—Spindles", Jun. 9, 2003—Courtesy of WayBackMachine (archive.org/web/), www.stairplan.co.uk/spindlespage3.htm.*

*Primary Examiner* — Edward Look
*Assistant Examiner* — Danielle M Christensen
(74) *Attorney, Agent, or Firm* — O'Shea Getz P.C.

(57) ABSTRACT

A damper pin for coupling platforms of adjacent turbine blades includes a first flat longitudinal end region, a second flat longitudinal end region and a reduced cross sectional area. The reduced cross sectional area is separated from the first flat longitudinal end region by a first main body region and the reduced cross sectional area is separated from the second flat longitudinal end region by a second main body region. The cross sectional area of the reduced cross sectional area is less than the cross sectional area of each of the first and second main body regions.

12 Claims, 8 Drawing Sheets

(56) References Cited

U.S. PATENT DOCUMENTS

| | | | | |
|---|---|---|---|---|
| 6,776,583 | B1 | 8/2004 | Wang et al. | |
| 6,984,112 | B2 | 1/2006 | Zhang et al. | |
| 7,021,898 | B2 | 4/2006 | Elliott et al. | |
| 7,090,466 | B2 * | 8/2006 | Honkomp et al. | 416/193 A |
| 7,147,440 | B2 | 12/2006 | Benjamin et al. | |
| 7,163,376 | B2 | 1/2007 | Itzel et al. | |
| 7,189,063 | B2 | 3/2007 | Honkomp | |
| 7,270,517 | B2 | 9/2007 | Garner | |
| 7,413,405 | B2 | 8/2008 | Busbey et al. | |
| 7,600,972 | B2 | 10/2009 | Benjamin et al. | |
| 7,762,781 | B1 | 7/2010 | Brown et al. | |
| 2005/0079062 | A1 | 4/2005 | Surace et al. | |
| 2006/0110255 | A1 * | 5/2006 | Itzel et al. | 416/193 A |
| 2006/0177312 | A1 | 8/2006 | Tomita et al. | |
| 2008/0181779 | A1 | 7/2008 | Decardenas | |
| 2009/0263235 | A1 * | 10/2009 | Tibbott et al. | 415/116 |
| 2012/0121424 | A1 * | 5/2012 | Wassynger et al. | 416/190 |

* cited by examiner

DAMPER PIN

This application is a divisional of U.S. patent application Ser. No. 13/048,618 filed Mar. 15, 2011, which is hereby incorporated by reference.

CROSS REFERENCE TO RELATED APPLICATIONS

This application contains subject matter related to application Ser. No. 13/048,634 filed Mar. 15, 2011, which is incorporated herein by reference.

BACKGROUND OF THE INVENTION

1. Technical Field

The present invention relates to the field of damper pins for turbine blades of gas turbine engines, and in particular to a damper pin separating platforms of adjacent turbine blades while allowing cooling air flow to the mate face of the adjacent blades.

2. Background Information

Turbine blades generally include an airfoil, a platform, a shank and a dovetail that engages a rotor disk. An axially extending damper pin couples adjacent turbine blades along their platform. To provide cooling air flow between the mate face of the adjacent blades, a scallop cut may be provided in the platform rail.

There is a need for improved cooling along the mate face of adjacent turbine blades.

SUMMARY OF THE INVENTION

According to an aspect of the invention, a damper pin for coupling platforms of adjacent turbine blades includes a first flat longitudinal end region, a second flat longitudinal end region and a reduced cross sectional area, where the reduced cross sectional area is separated from the first flat longitudinal end region by a first main body region and the reduced cross sectional area is separated from the second flat longitudinal end region by a second main body region, where the cross sectional area of the reduced cross sectional area is less than the cross sectional area of each of the first and second main body regions.

According to another aspect of the invention, a damper pin for coupling platforms of adjacent turbine blades includes a first flat longitudinal end region, a second flat longitudinal end region and an undercut region, where the undercut region is separated from the first flat longitudinal region by a first cylindrical main body region and the undercut region is separated from the second flat longitudinal region by a second cylindrical main body region.

According to yet another aspect of the invention, a damper pin for coupling platforms of adjacent turbine blades includes a first flat longitudinal end region, a second flat longitudinal end region and a longitudinal slit radially extending through the pin, where the slit is separated from the first flat longitudinal end region by a first main body region and the slit is separated from the second flat longitudinal end region by a second main body region.

According to a further aspect of the invention, a damper pin for coupling platforms of adjacent turbine blades includes a first flat longitudinal end region, a second flat longitudinal end region and a helical undercut surface region, where the helical undercut surface region is separated from the first flat longitudinal end region by a first main body region and the undercut surface region is separated from the second flat longitudinal end region by a second main body region.

The first and second main body regions may be cylindrical. The undercut region may also be cylindrical.

The mate faces of the adjacent turbine blades are cooled by air passing through the pin in one embodiment, and around diameter reduction areas in other embodiments. The pin may also include positioning mistake proof features on one of its longitudinal end regions.

The foregoing features and the operation of the invention will become more apparent in light of the following description and the accompanying drawings.

DETAILED DESCRIPTION OF THE INVENTION

Figure 1:
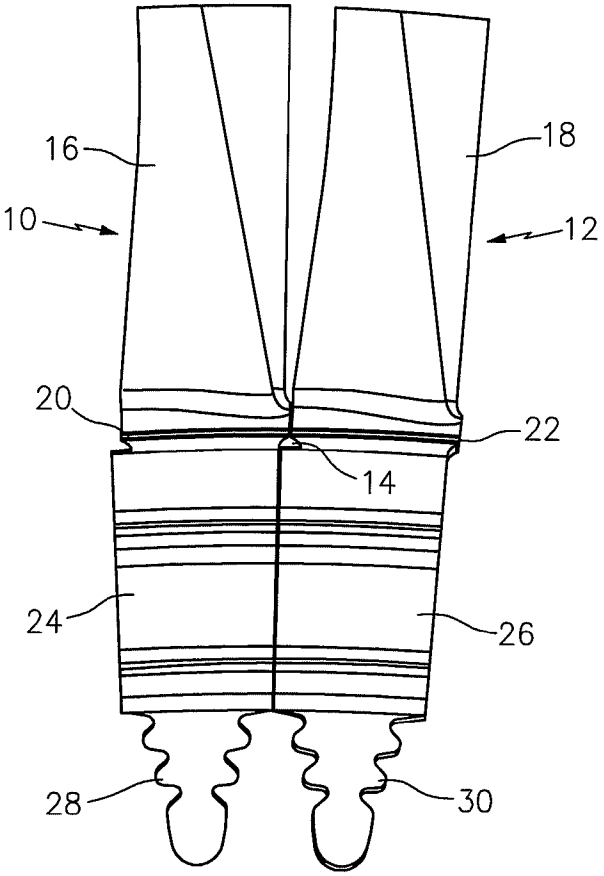
FIG. 1 is a pictorial illustration of adjacent turbine blades coupled by a damper pin.

FIG. 1 is a pictorial illustration of adjacent gas turbine blades 10, 12 coupled by a damper pin 14. Each of the blades 10, 12 extends radially outward from a rotor disk (not shown), and includes an airfoil 16, 18, a platform 20, 22, a shank 24, 26, and a dovetail 28, 30, respectively. The airfoil, platform, shank, and dovetail are collectively known as a bucket.

Figure 2:
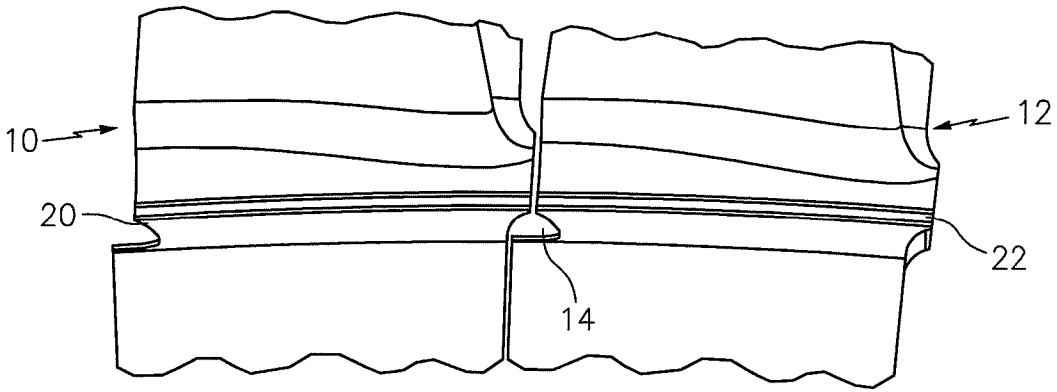
FIG. 2 is an exploded view of the damper pin coupling the adjacent turbine blades.
Figure 3:
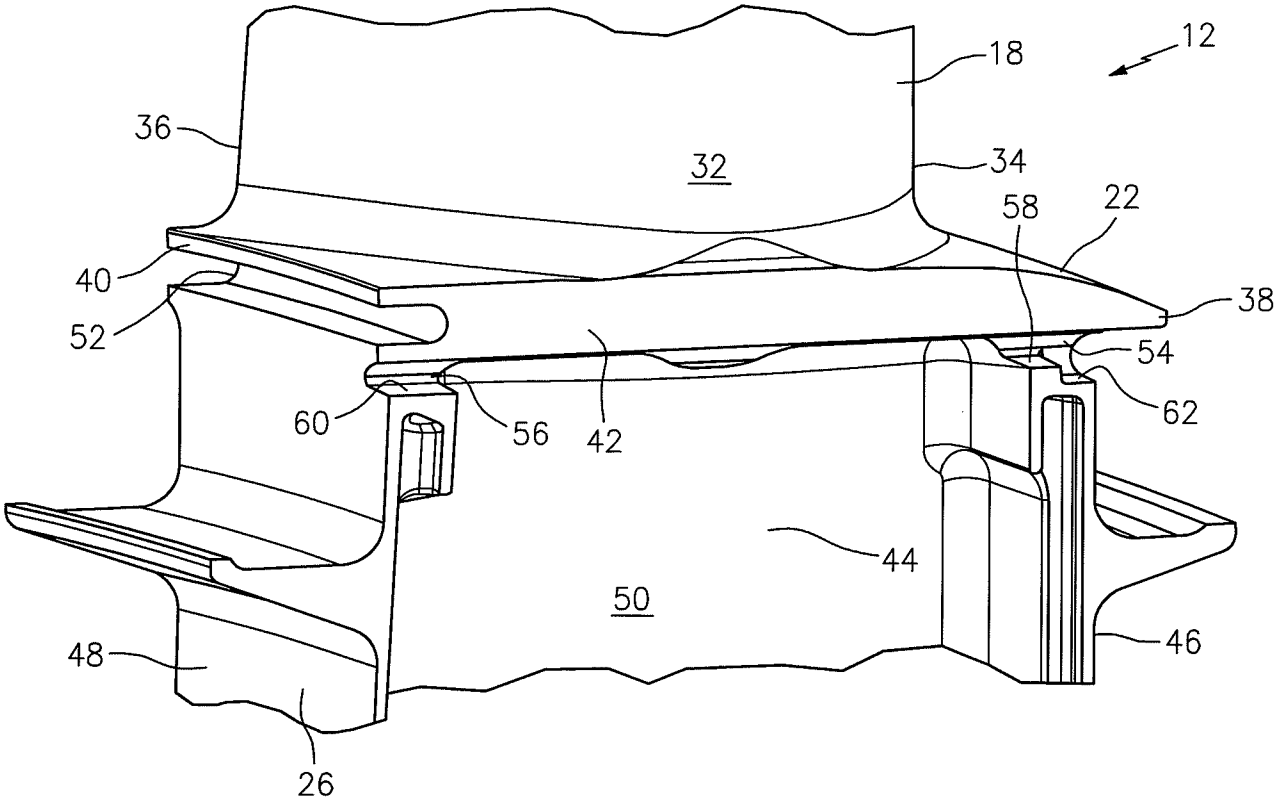
FIG. 3 is a perspective view of the platform region of a turbine blade.

FIG. 2 is an exploded view of the pin 14 coupling the adjacent turbine blades 10, 12. FIG. 3 is a perspective view of the platform region 22 of the turbine blade 12. The airfoil 18 includes a convex suction side 32 and an opposite concave pressure side (not shown), and a leading edge 34 and a trailing edge 36.

The platform 22 separates the airfoil 18 and the shank 26, and includes an upstream side 38 and a downstream side 40 that are connected together with a suction-side edge 42 and an opposite pressure-side edge (not shown).

The shank 36 includes a substantially convex sidewall 44 and an opposite substantially concave sidewall (not shown) connected together at an upstream sidewall 46 and a downstream sidewall 48 of the shank 26. When coupled within the rotor disk, the substantially convex sidewall 44 of the blade 12 and the substantially concave sidewall of the blade 10 form a shank cavity 50 between the adjacent shanks 24, 26.

A platform undercut 52 is defined within the platform 22 for trailing edge cooling. A first channel 54 and a second channel 56 extend (e.g., axially) from the platform for receiving the damper pin 14 (FIGS. 1 and 2). The first channel 54 includes a first pedestal surface 58 on the upstream side, and the second channel 56 includes a second pedestal surface 60 on the downstream side. A notch 62 is located on the upstream side of the first pedestal surface 58.

Figure 4:
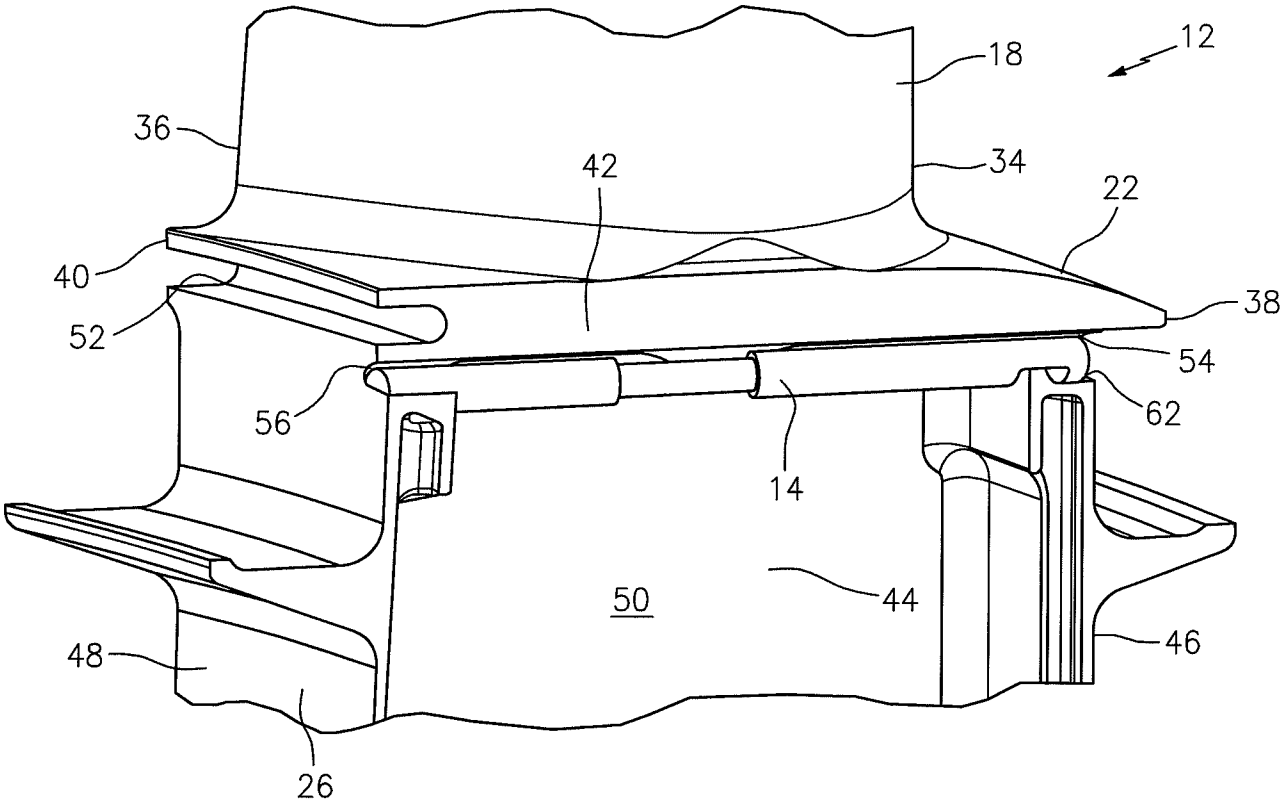
FIG. 4 is a perspective view of the platform region with the damper pin in its registered operable position on the platform region of the turbine blade of FIG. 3.
Figure 5A:
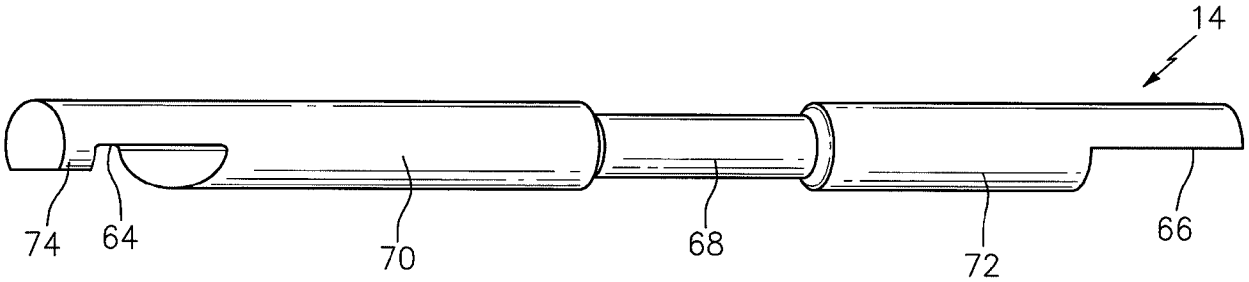
FIGS. 5A-5C illustrate a first embodiment of the damper pin in various axially rotated views.
Figure 5B:
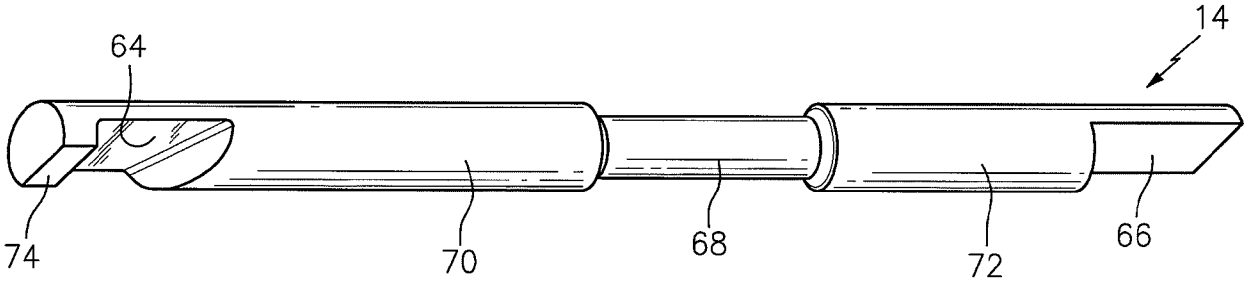
Figure 5C:
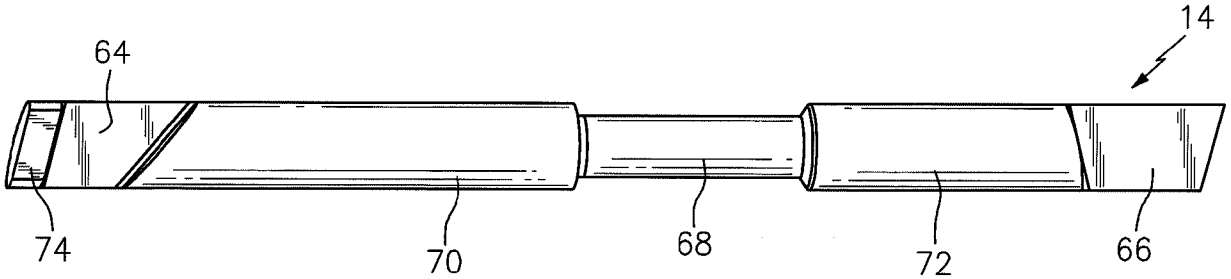

FIG. 4 is a perspective view of the platform region of the turbine blade 12 with the pin 14 in its operable position within the first and second channels 54, 56. FIGS. 5A-5C illustrate a first embodiment of the damper pin 14 in various axially rotated views. Referring now to FIGS. 4 and 5A-5C, the damper pin includes a first flat longitudinal end region 64, a second flat longitudinal end region 66 and a reduced cross sectional area/undercut region 68. The reduced cross sectional area/undercut region 68 is separated from the first flat longitudinal end region 64 by a first main body region 70, and separated from the second flat longitudinal end region 66 by a second main body region 72. To allow cooling air to flow radially outward from the shank cavity 50 to the suction-side edge 42 of the platform, the cross section of the reduced cross sectional area/undercut region 68 is less than the cross sectional area of each of the first and second main body regions 70, 72. The cross sectional area/undercut region 68 is coaxial/concentric with respect to both the first and second main regions 70, 72, and the cooling air flows from the shank cavity 50 along opposite sides of the reduced cross sectional area/undercut region at the same axial position along the pin. The first and second longitudinal end regions may have a semi-circular cross section.

To prevent position mistakes of the pin 14 within the channels 54, 56, the 14 includes a projection 74 at the longitudinal end of the first flat longitudinal end region 64. The projection 74 seats in the notch 62 (see FIG. 4). The pin may be a metal alloy such as for example IN100, IN718, IN625 or INCONEL® X-750 alloys.

The depths and width of the reduced cross sectional area 68 of the pin are selected based upon the desired amount of cooling flow to the side edges of the platform (e.g., side edge 42 of the platform 22). For example, in the pin embodiment illustrated in FIGS. 4 and 5A-5C, the reduced cross sectional area may have a diameter of about 0.200 inches, while the first and second main body regions 70, 72 may have a diameter of about 0.310 inches. The length of the pin 14 is selected to run from about the upstream sidewall to about the downstream sidewall.

Figure 6:
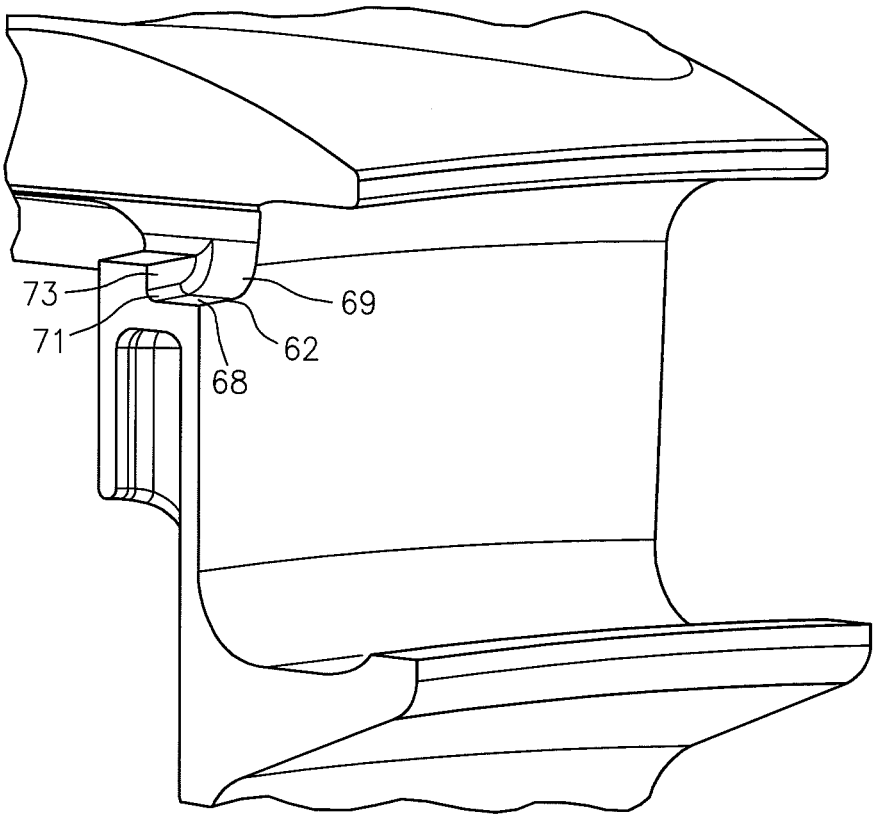
FIG. 6 is an exploded perspective view of the platform in the area of a notch that seats a projection on the pin.

FIG. 6 illustrates an exploded perspective view of the notch 62. The notch is formed by a straight flat surface 68 and an arcuate surface 69 that extends from the flat surface. The notch 62 is also formed by notch sidewall surfaces 71, 73. The surface 68 may be substantially parallel to the first and second pin channels 54, 56 (FIG. 3), while the sidewall surface 73 may be substantially perpendicular to the damper channels. The notch 62 may be formed by machining during manufacture of the bucket, or during overhaul or repair of the bucket.

Figure 7A:
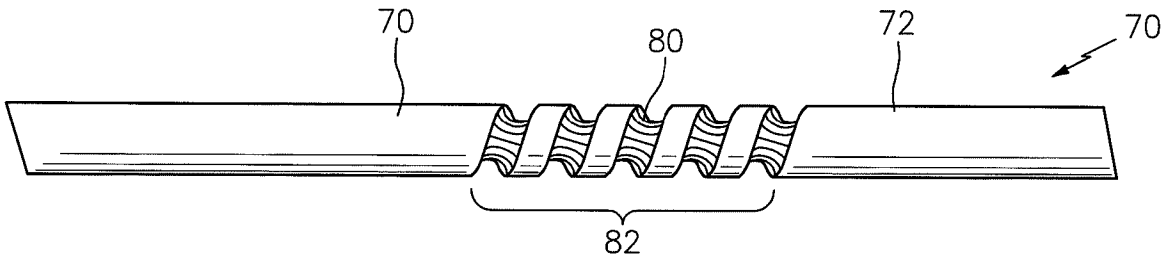
FIGS. 7A-7C illustrate a second embodiment of the damper pin in various axially rotated views.
Figure 7B:
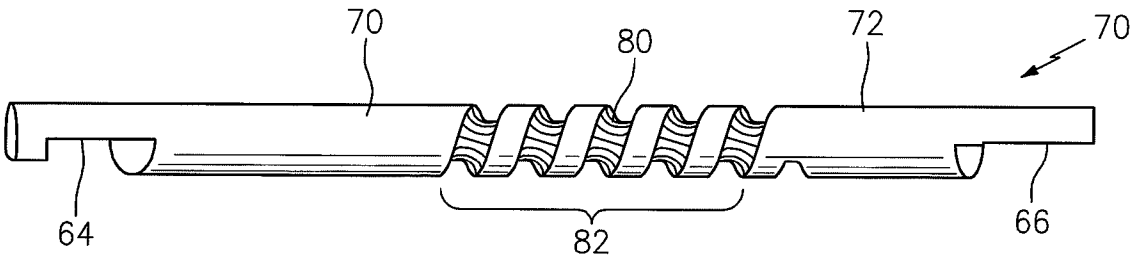
Figure 7C:
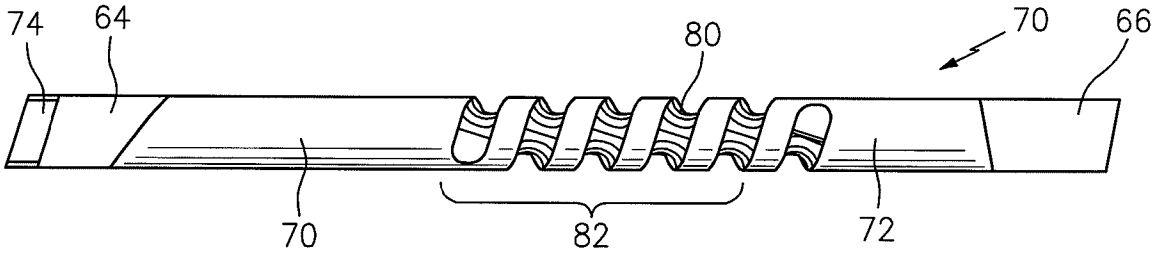

FIGS. 7A-7C illustrate a second embodiment of a damper pin 70 in various axially rotated views. The pin 70 is substantially similar to the pin 14; the two differ primarily in that the undercut region which allows cooling air to pass is formed by a continuous helical cut/channel 80 along the surface of the pin within a helical undercut region 82. The helical undercut region 82 is separated from the first flat longitudinal end region 64 by the first cylindrical main body region 70, and from the second flat longitudinal end region 66 by the second cylindrical main body region 72. The helical cut allows cooling air to flows from the shank cavity 50 along opposite sides of the pin within the helical undercut region 82.

Figure 8A:
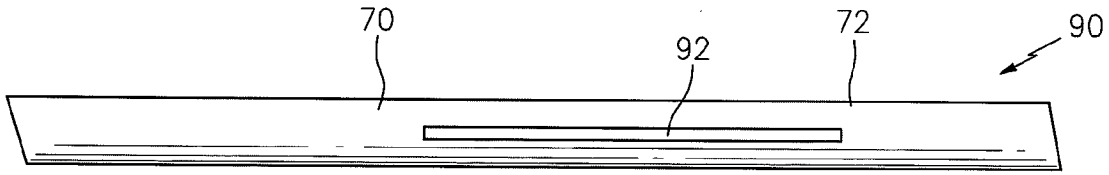
FIGS. 8A-8C illustrate a third embodiment of the damper pin in various axially rotated views.
Figure 8B:
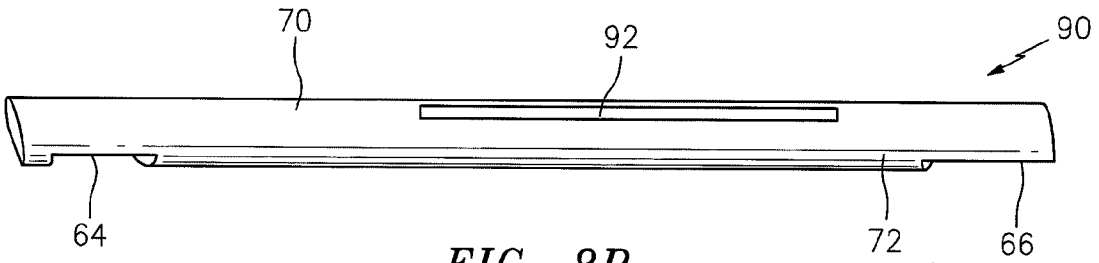
Figure 8C:
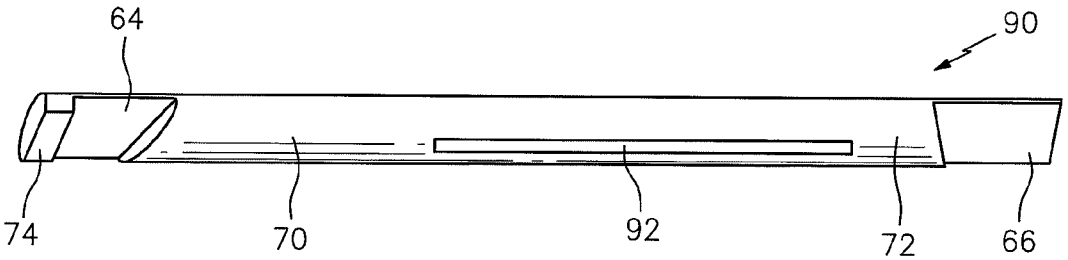

Rather than removing material from the surface of the pin to allow cooling air to radially pass from the shank cavity 50 to the side edges of the platform, one or more radial through holes may be formed within the pin. For example, FIGS. 8A-8C illustrate a damper pin 90 in various axially rotated views. The pin 90 is substantially similar to the pin 14 illustrated in FIGS. 5A-5C; the two differ primarily in that a longitudinal slit 92 radially extends through the pin, allowing cooling air to flow from the shank cavity 50 to the side edges (e.g., see side edge 42 illustrated FIG. 3). The slit 92 is separated from the first flat longitudinal end region 64 by the first main body region 70, and from the second flat longitudinal end region 66 by the second main body region 72. One of ordinary skill will immediately recognize that the slit may be replaced by a plurality of individual through holes in order to provide the desired cooling flow.

Figure 9:
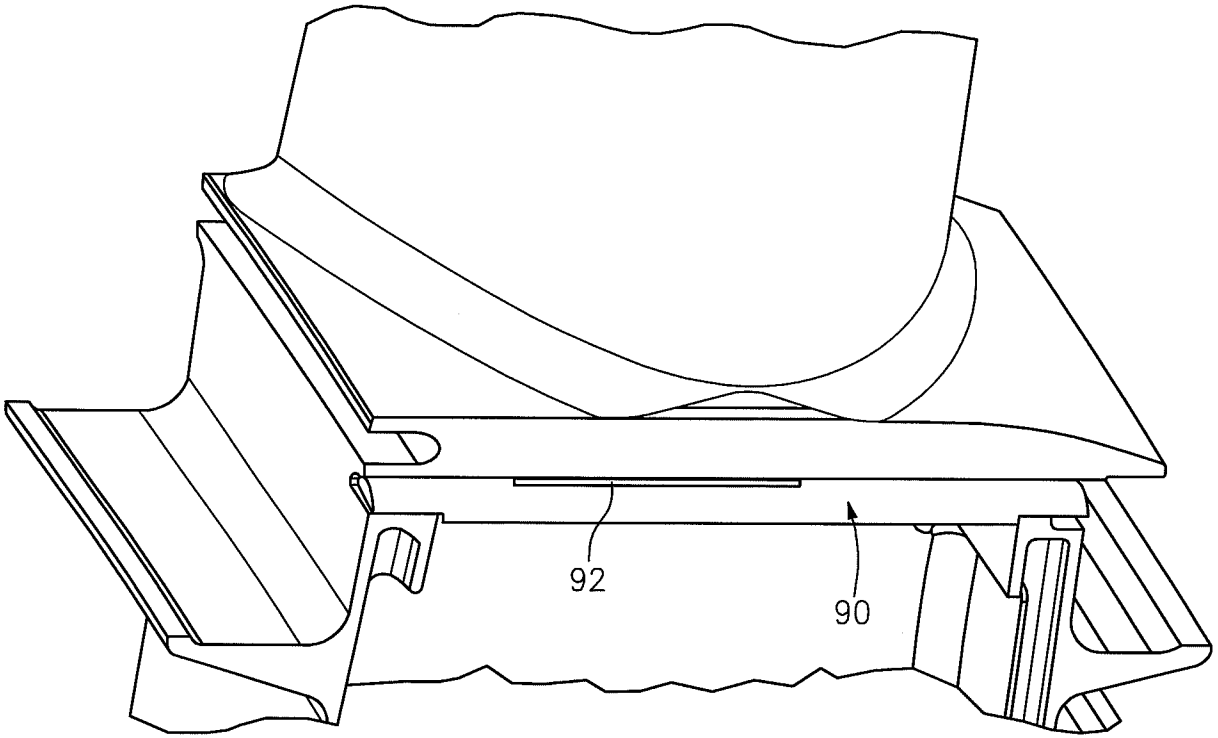
FIG. 9 is a perspective view of the platform region of the turbine blade with the damper pin of FIGS. 8A-8C in its registered operable position on the platform region of the turbine blade.

FIG. 9 is a perspective view of the platform region of the turbine blade with the damper pin of FIGS. 8A-8C in its operable position on the platform region of the turbine blade.

One of ordinary skill will also recognize that the first and second main body regions may take on shapes other then cylindrical. For example, it is contemplated these regions may be rounded surfaces such as ovals or other surfaces, for example having flat faces such as hexagon, diamond and square. The first and second main body regions may also take upon the shape of the adjacent platform surfaces to maintain effective air sealing.

Although this invention has been shown and described with respect to the detailed embodiments thereof, it will be understood by those skilled in the art that various changes in form and detail thereof may be made without departing from the spirit and scope of the claimed invention.

What is claimed is:

1. A pin for coupling platforms of adjacent turbine blades, the pin comprising:

a first flat longitudinal end region;

a second flat longitudinal end region;

a longitudinal slit radially extending through the pin; and where the slit is separated from the first flat longitudinal end region by a first main body region and the slit is separated from the second flat longitudinal end region by a second main body region, and the first and second flat longitudinal end regions are undercut with respect to the first and second main body regions; and where a longitudinal length of the longitudinal slit is longer than a longitudinal length of the first main body region.

2. The pin of claim 1, further comprising a projection radially extending from the longitudinal end of the first flat longitudinal end region.

3. The pin of claim 2, where the first and second main body regions are cylindrical.

4. The pin of claim 1, where the pin is formed from a metal alloy selected from the group consisting of IN100, IN718, IN625 and INCONEL X-750.

5. The pin of claim 4, where the first and second main body regions are cylindrical.

6. A pin for coupling platforms of adjacent turbine blades, the pin comprising:

a first flat longitudinal end region;

a second flat longitudinal end region;

an undercut region; and where the undercut region is separated from the first flat longitudinal end region by a first main body region and the undercut region is separated from the second flat longitudinal end region by a second main body region, and the undercut region is undercut with respect to the first and second main body regions, and a projection radially extends from the longitudinal end of the first flat longitudinal end region; and where the undercut region is formed by a continuous helical cut about the surface of the undercut region that allows cooling air to flow along opposite surfaces of the pin.

7. A pin for coupling platforms of adjacent turbine blades, the pin comprising:

a first flat longitudinal end region;

a second flat longitudinal end region; and a reduced cross sectional area; and a projection radially extending from the longitudinal end of the first flat longitudinal end region;

where the reduced cross sectional area is separated from the first flat longitudinal end region by a first main body region and the reduced cross sectional area is separated from the second flat longitudinal end region by a second main body region, where the cross sectional area of the reduced cross sectional area is less than the cross sectional area of each of the first and second main body regions, and the reduced cross sectional area is concentric with the first and second main body regions;

where the first flat longitudinal end region, the second flat longitudinal end region, the first main body region and the second main body region are integrally formed together; and where a longitudinal length of the first main body region is longer than a longitudinal length of the reduced cross sectional area.

8. The pin of claim 7, where the reduced cross sectional area is formed by a continuous undercut in the surface of the reduced cross sectional area.

9. The pin of claim 7, where the pin is formed from a metal alloy.

10. The pin of claim 7, where the pin is formed from a metal alloy selected from the group consisting of IN100, IN718, IN625 and INCONEL X-750.

11. A pin for coupling platforms of adjacent turbine blades, the pin comprising:

a first flat longitudinal end region;

a second flat longitudinal end region; and a reduced cross sectional area;

where the reduced cross sectional area is separated from the first flat longitudinal end region by a first main body region and the reduced cross sectional area is separated from the second flat longitudinal end region by a second main body region, were the cross sectional area of the reduced cross sectional area is less than the cross sectional area of each of the first and second main body regions, and the reduced cross sectional area is concentric with the first and second main body regions; and where the first flat longitudinal end region and the first main body region share a curved surface.

12. The pin of claim 11, wherein a curved surface of the reduced cross sectional area is radially recessed from the curved surface shared by the first flat longitudinal end and the first main body region.

* * * * *